United States Patent [19]

Hancock

[11] 4,170,358

[45] Oct. 9, 1979

[54] PLAYING CARDS

[76] Inventor: Herbert C. Hancock, 9 Penge Ct., Dundas, Ontario, Canada, L9H 4R3

[21] Appl. No.: 852,831

[22] Filed: Nov. 18, 1977

[51] Int. Cl.[2] ..... A63F 1/02

[52] U.S. Cl. ..... 273/304; 273/306

[58] Field of Search ..... 273/292, 303, 304, 305, 273/306, 148 R

[56] References Cited

U.S. PATENT DOCUMENTS

| | | | |
|---|---|---|---|
| D. 83,342 | 2/1931 | Niederlitz | 273/304 X |
| D. 230617 | 5/1974 | Ekstrand | 273/292 |
| 821,781 | 5/1906 | Cadwallader | 273/304 |
| 1,437,680 | 12/1922 | Rabow | 273/148 R |

FOREIGN PATENT DOCUMENTS

| | | | |
|---|---|---|---|
| 193375 | 1/1938 | Switzerland | 273/303 |
| 23078 | of 1909 | United Kingdom | 273/304 |
| 24658 | of 1910 | United Kingdom | 273/304 |

*Primary Examiner*—Anton O. Oechsle

*Attorney, Agent, or Firm*—Hirons, Rogers & Scott

[57] ABSTRACT

A pack of playing cards comprises forty eight split-value cards, the front face of each of which is divided into two visually distinctive zones by means of a diagonal dividing line. Each of the visually distinctive zones represents a different playing card suit-value combination, the arrangement being such that, through the forty eight split-value cards, there is a first zone representing each of the card values ace through three of each of the four suits clubs, diamonds, hearts and spades, and similarly there is a card with the second visually distinctive zone representing each of the same forty eight card suit-value combinations. There is no coupling of similar card-values on the same card of the forty eight split-value cards. The pack is completed with four deuce cards, each having two visually distinctive zones, but both of the zones representing the deuce of the same suit. The pack may also include one or more jokers of conventional design to be used as wild cards. There may be also included indicator cards which are selectively displayed to indicate which of the visually distinctive zones, or both, is in play.

6 Claims, 8 Drawing Figures

PLAYING CARDS

FIELD OF THE INVENTION

This invention relates to playing cards, of the familiar generally rectangular type, each card of the pack having generally identical sizes and rear faces, and front faces denoting values, deuce through ace, of the different suits. More particularly, it relates to a pack of playing cards in which most of the individual cards represent two different card values.

BACKGROUND OF THE INVENTION AND DESCRIPTION OF PRIOR ART

Packs of playing cards, comprising fifty-two cards each denoting a different value of one of four common suits clubs, diamonds, hearts and spades, have a long and ancient history. There have been many proposals in the past for new shapes and kinds of playing cards, for playing different card games, variation of old card games, etc. It is also known to provide a pack of cards in which each individual card represents more than one value, as indicated on its front face.

For example, Canadian Pat. No. 261,488 McCarroll, issued June 8, 1926, shows a pack of cards in which each card has on its front face an inner portion representing one card value, and a perimetric outer portion representing a different card value. The pack thus consists essentially of two decks, each comprising a full deck of fifty two cards, but the total pack only numbering fifty two cards in all. The players elect to play the inner card value or the outer card value, in a card game.

Canadian Pat. No. 151,212 Morrison, issued Apr. 11, 1911, shows a pack of playing cards which resemble dominoes, each card being equatorially split into two zones across its centre, each zone of a card representing a different value, of the same suit.

U.S. Pat. Design No. 222,490 shows a deck of cards which are split into two values across the middle by means of transparent/opaque layers in each half.

U.S. Pat. No. 1,798,672 shows a pack of cards having a diagonal strip dividing them into two areas, but each area represents the same denomination of card.

U.S. Pat. No. 1,693,525 shows a deck of cards which appear to be similar to those in Canadian Patent 261,488 above, with inner and outer zones representing different values. This patent shows the use of eight different suits in a fifty two card pack.

U.S. Pat. Design No. 169,847 shows a pack of cards, each of which has two face values, the card being divided longitudinally down the center. Other examples of split cards are to be found in U.S. Pat. No. 821,781 and U.S. Pat. No. 1,551,761.

None of the above packs of split playing cards has achieved widespread acceptance, despite their apparently offering increased ranges of card playing possibilities. In most cases, the arrangement of the two zones on the split cards of the prior art renders them difficult and confusing to read and play, when held in a normal card hand. Whilst such packs of cards may in fact represent two distinct decks, one comprised of each area of the card faces, their arrangement has rendered it virtually impossible to play a card game using both of such decks at the same time. Moreover, the specific couplings of suit/card values on an individual card have been inappropriate, resulting in a pack of cards which is unsatisfactory in play.

SUMMARY OF THE INVENTION

It is an object of the present invention to provide a new improved pack of playing cards. It is a further object to provide a pack of cards in which most of the cards are split to denote two different suit/card values, but with which it is nevertheless simple and easy to play card games.

The present invention provides a pack of playing cards comprising fifty two cards, each having the same rectangular configuration and size, and a visually similar rear face. The front face of each card is divided into first and second visually distinctive zones each of the first and second zones representing standard playing card value selected from deuce through ace, of a standard playing card suit selected from club, diamond, heart and spade. Forty eight of the fifty two cards are split-value cards, the first zone of each split value card representing a different value/suit combination from the combination represented by the second zone of the same split-value card. The division between the first zone and the second zone of the front face of each of the forty eight split-value cards is along a diagonal line passing through the approximate diagonal center of the respective split-value card, and extending diagonally from the diagonal center towards respective opposed points on the shorter sides of the card located at or between the corner of said card and a location $\frac{3}{8}$ of the distanace along the shorter side thereof.

This method of division of the front face of the card leads to significant advantages in the pack of cards according to the invention. When a selection of cards of the invention is held in the hand in the form of a fan, as in a normal playing hand, only one of the two zones is visible to the holder, from all except the top, exposed card. This is so, even when as few as four cards are in the hand. In the arrangements of the prior art, the second zone of the split card cannot be conveniently concealed in small hands, in normal holding and playing procedures, which leads to confusion on the part of the players and therefore detracts from the enjoyment of the game. It also effectively prevents the use of the prior art packs as mixed decks, using first zones on some of the cards in the hand and second zones on others. In the present invention, the cards in the hand have most of the appearance of a standard deck, and do not lead to such confusion. The individual values, suits and representations thereof remain unchanged, so that the player's basic familiarity with a standard pack of cards is utilized and is not affected.

DESCRIPTION OF THE PREFERRED EMBODIMENTS

Preferably, the split deck of cards according to the invention has forty eight split-value cards and four residual cards, which are the deuces of the pack. Thus the deck includes a card having first and second visually distinctive zones, both of which represent two of diamonds, and similar single split cards representing two of clubs, two of hearts and two of spades respectively. In many standard card games, the deuce is played as a "wild" card (or card of variable value) so that its retention as a single card, although split into two visually distinctive zones, in the preferred pack according to the invention is advantageous for playing such games.

The preferred pack of cards according to the invention also has an arrangement of card value couplings devised according to a predetermined set of general guidelines, the objective of which is to yield a pack of cards which essentially comprises two decks, conveniently referred to as a major deck and a minor deck, which are far apart from each other in terms of coupled values. The first visually distinctive zone of each split card, which may conveniently have a distinctive background color e.g. yellow, is the major deck. The second visually distinctive zone, e.g. on white background, is the minor deck. Standard but slightly modified card games are played with the pack, in some instances with the players electing to play a major deck or a minor deck. The couplings on the split cards are preferably arranged to maintain reasonably equal balance between the minor deck and the major deck, in a given selection of split cards comprising one player's hand.

Thus, in the preferred pack, honor cards are not coupled together. The coupling of, say, a major deck ace with a minor deck ace, king, queen or jack would be to create a single card of too high a relative value, the presence of which in a hand for a game such as poker, bridge or whist would unduly unbalance the card distributions and detract from the enjoyment of the game.

Also in a preferred pack according to the invention, all of the eight split cards which have one of their respective first and second zones representing a given honor card value have their respective complementary second or first zones representing a card value different from that of the other seven of said eight honor value representing split cards. In other words, there are eight ace split cards in the pack—four major deck aces and four minor deck aces. These eight cards are coupled with one three, one four, one five, one six, one seven, one eight, one nine, and one ten. The avoidance of the presence of two similarly split cards such as two ace—four coupled cards prevents cards of undue value in games such as poker, by avoiding the situation of creating two poker pairs with only two individual cards.

Further, to maintain proper balance distribution through the major and minor decks, it is preferred that, among the twelve cards in which the first zone represents the values three through ace of a given suit selected from clubs, diamonds, hearts and spades, there are three cards of which the second zone represents a club value, three cards of which the second zone represents a diamond value, three cards of which the second zone represents a heart value and three cards of which the second zone represents a spade value. In other words, in the case of the twelve split cards in which the suit of the major deck is spades, the minor deck complement therefor consists of three spades, three diamonds, three clubs and three hearts. This is true for all the major and minor deck suits, throughout the pack. This even distribution of suit complements enhances the playing of a card game in which collection of cards of the same suit is important, e.g. poker in which to construct a flush. It also reduces or eliminates the chance of a player's voiding a suit in both major and minor decks, for playing of the game of hearts with undue advantage.

It is also preferred that the division line between the first zone and the second zone of each of the forty eight split caeds comprise a straight diagonal line passing through the diagonal center of the card and extending toward points on the shorter side of the card which are from ½ to 2 cm from the top right and bottom left corners of the front face thereof, as the card is held upright and viewed towards the front face, for a normal sized playing card of dimensions about 6 cm ×9 cm, and proportionately for other size cards. The division line at a point about ½–1½ cm from the respective shorter sides should make an obtuse angled turn and proceed parallel with the shorter sides to intersect the respective longer sides a distance of about ½ to 1½ cm from the respective top right and bottom left corners. This enhances the holding of a hand of the split cards in the standard way with effective concealment of the inoperative deck value, when required. Indicia denoting the major deck value of the card, on the minor deck zone, may advantageously be provided, for games in which the decks are used simultaneously or interchangeably.

A pack of cards according to the invention may advantageously include one or more jokers, in the usual way. It is not desirable to split the joker, since it is generally used as a wild card. There may also be included indicator cards, the purpose of which is to be displayed so as to indicate to the players which of the major or minor decks, or both, is in play.

The accompanying drawings illustrate diagrammatically a pack of cards according to the invention, with values of the split cards coupled as described above, it being understood that this arrangement of values is illustrative only, and not exhaustive. There then follows a description of the general mode of playing a selection of standard card games with the pack of cards as illustrated.

REFERENCE TO THE DRAWINGS

DESCRIPTION OF THE SPECIFIC PREFERRED EMBODIMENT

Figure 1:
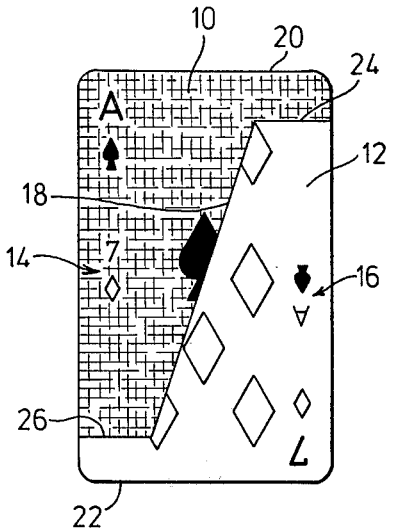
FIG. 1 shows a front face of a split card comprising one of a pack of cards according to the invention.

The split card shown in FIG. 1, which is typical of the forty eight split cards making up the pack, has a first, major zone 10 representing the ace of spaces, and a second, minor zone 12 representing the seven of diamonds. The two zones are of substantially equal area, but visually distinct, the major zone 10 having a yellow colored background and the minor zone 12 having a white background. The zones bear indicia of the normal playing card, i.e. effectively being half a standard playing card, with the exception of the addition of small indicia 14, 16 in the respective major and minor zones near the edge thereof, to indicate the value represented by the other zone.

The division between the first zone 10 and the second zone 12 has a straight central part 18 passing through the diagonal center of the card and directed diagonally from a point on the top short edge 20 located about ¼ of the length of the edge 20 from the right hand end thereof, to a corresponding point on the bottom edge 22 thereof. At points about 1 cm from the respective short edges 20, 22, the division makes an obtuse angle and proceeds in end portions 24, 26 parallel to respective short edges 20, 22 to the side of the card.

Figure 2:
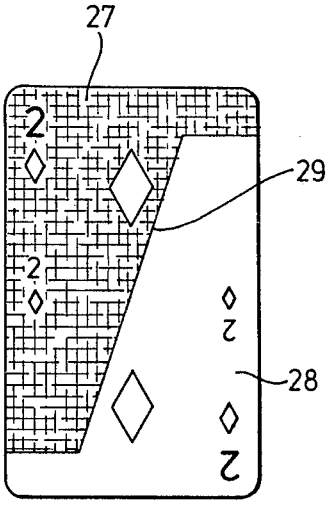
FIG. 2 shows the front face of a deuce of the pack.

As shown in FIG. 2, each deuce of the pack is similarly arranged, with a first major zone 27 colored yellow, a second minor zone 28 colored white, and a dividing line 29 between the zones as described above. In the case of the deuce cards, however, both zones represent the same card value/suit combination.

Figure 3:
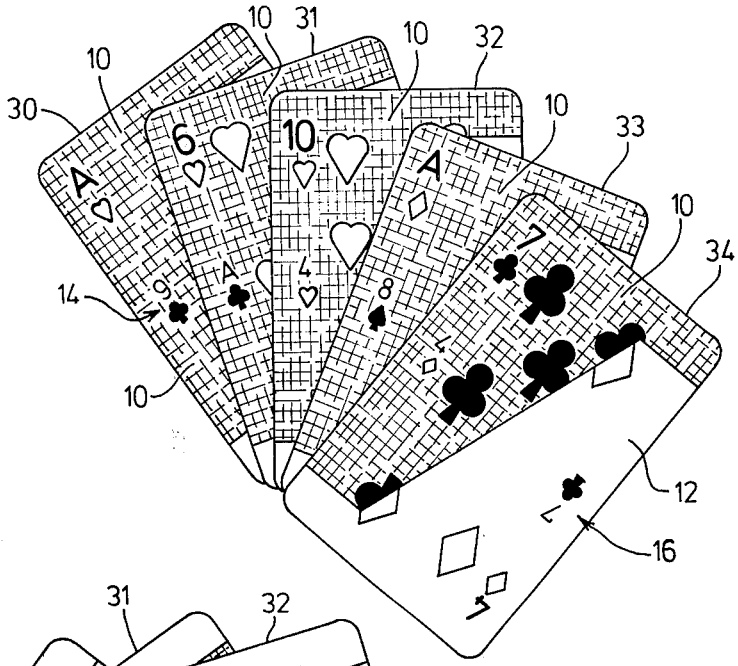
FIG. 3 shows a hand of five split cards of the pack, with the major deck in play.

FIG. 3 shows a hand of five split cards, assembled in the normal fan arrangement in which the majority of card games are played. The five cards are, specifically, ace of hearts major—nine of clubs minor 30, six of hearts major—ace of clubs minor 31, ten of hearts major—four of hearts minor 32, ace of diamonds major—eight of spades minor 33, and seven of clubs major—four of diamonds minor 34. In each case, the major zone 10 of the card is presented upwardly, and except in the case of the top card 34, only the major zone 10 is visible to any significant extent. In practice, the player would normally conceal much of the minor zone 12 of the top card 34 with the hand holding the fan of cards. To all intents and purposes, the hand then only shows a single deck of cards, the major deck, and can be viewed, read and played without confusion to the player. Small indicia 14 denoting the appropriate minor suit value remain visible.

Figure 4:
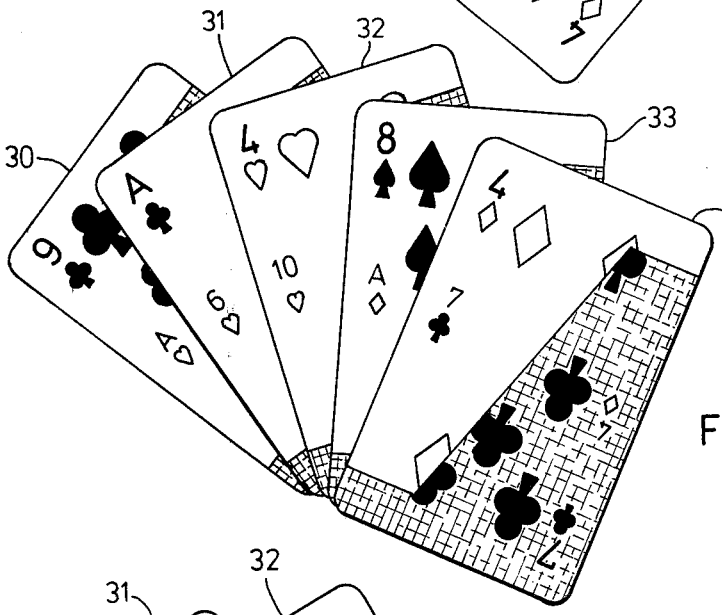
FIG. 4 shows the same hand of cards as in FIG. 3, but with the minor deck in play.

FIG. 4 shows the same four cards from the pack as illustrated in FIG. 3, in the same order in a hand, but held so that their minor deck zones 12 are displayed to the player instead of their major deck zones 10. Effectively the hand of cards has been reversed, but it will be apparent that the appearance of the hand as shown in FIG. 4 is very similar to that of a normal hand of playing cards, and can be read and played as such, without causing confusion to the player holding the hand.

Figure 5:
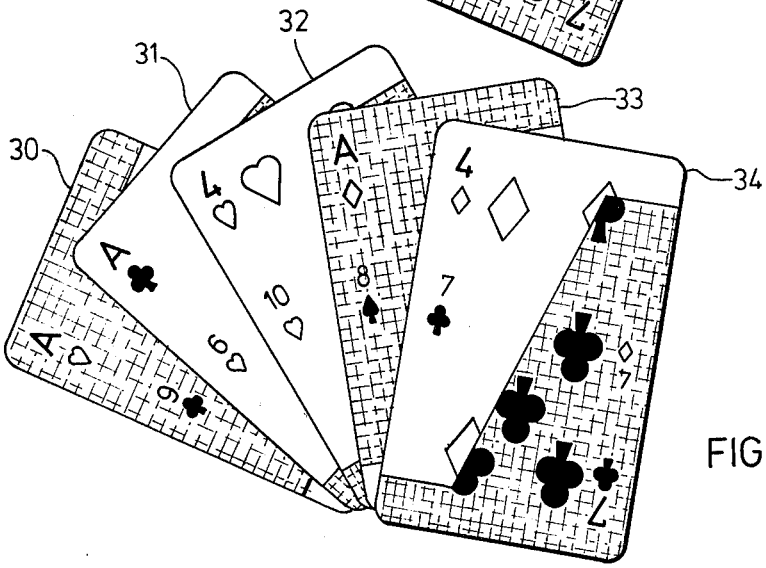
FIG. 5 shows the same hand of cards as in FIGS. 3 and 4, but with a mixed deck in play.

FIG. 5 shows the same four cards again, but in this case, cards 30 and 33 are held to display their major deck zones 10 and cards 31, 32 and 34 are held to display their minor deck zones 12. This is a position which may be adopted when playing with the mixed deck, e.g. in a game such as poker where according to a predeclared rule, players may be permitted to choose for each individual card whether it shall represent its minor suit-value combination or its major suit-value combination. Such a mode of play is not applicable to prior art cards discussed above.

FIGS. 3, 4 and 5 show that, with the pack according to the invention, a hand may be played in any one of three different ways, thereby adding extra variety, interest and versatility to a card game, but in each of the three ways the hand has the appearance of a normal hand of cards.

Figure 6:
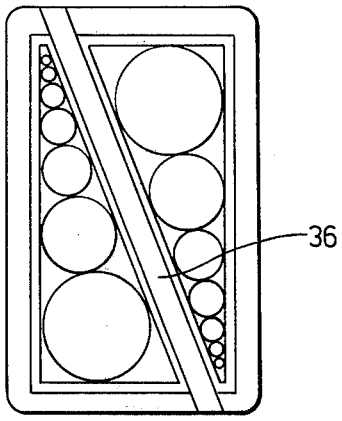
FIG. 6 shows the the rear face of a card of the pack.

FIG. 6 shows a typical design of a rear face of the cards of the pack. All of the cards in the pack have the same rear face so that they are indistinguishable from one another. For convenience in indicating that the pack is split in accordance with the invention, the rear face design is provided with a diagonal divide 36. The rear face design is symmetrical about the divide 36, so that an opponent cannot tell whether a player is holding his hand to view his major or minor deck hand.

Figure 7:
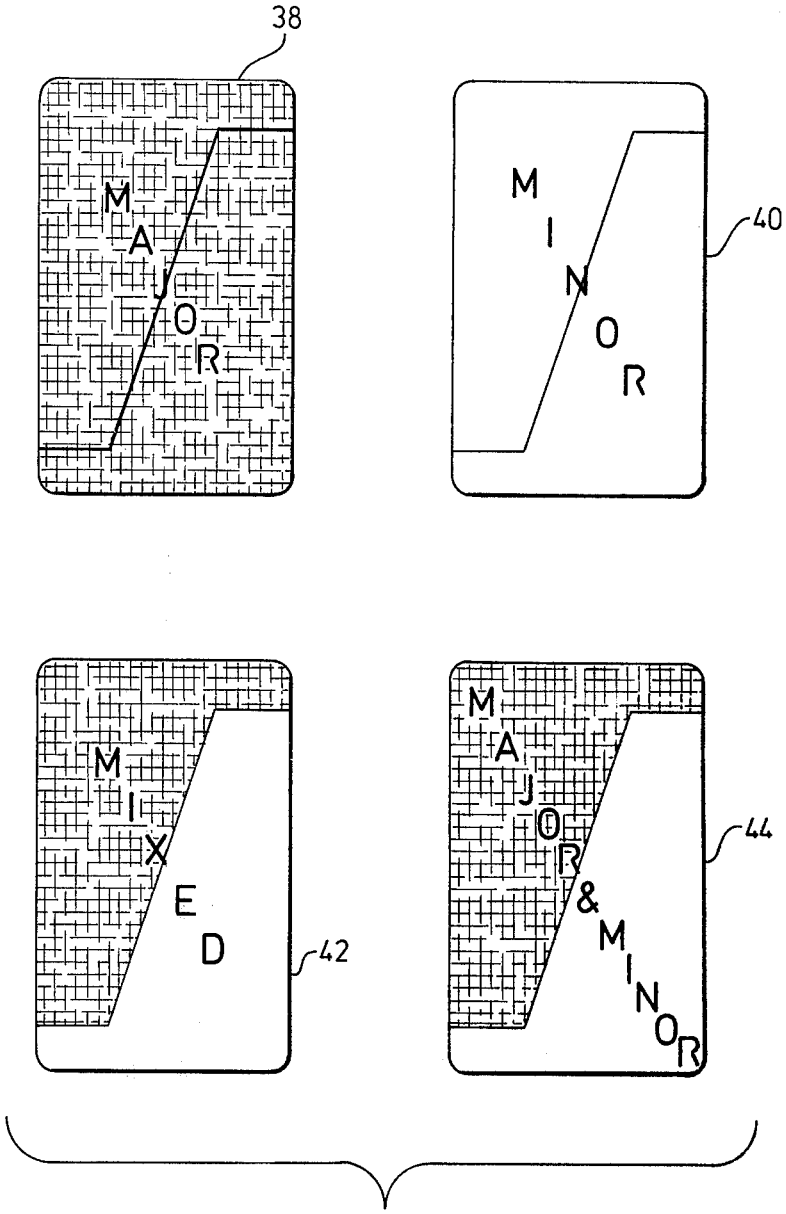
FIG. 7 shows the front face of the group of indicator cards of the pack.

FIG. 7 shows the front face of each of four indicator cards which may be included in the pack according to the invention. The card 38 is labelled "major", and is displayed when the game is being played with the pack but using the major deck only. Similarly, card 40 is labelled "minor" as is displayed when the game is being played using the minor deck only. When a game is played in which the mixed deck is used, card 42 is displayed. When a game is played utilizing both major and minor decks of the pack, card 44 is displayed.

Figure 8:
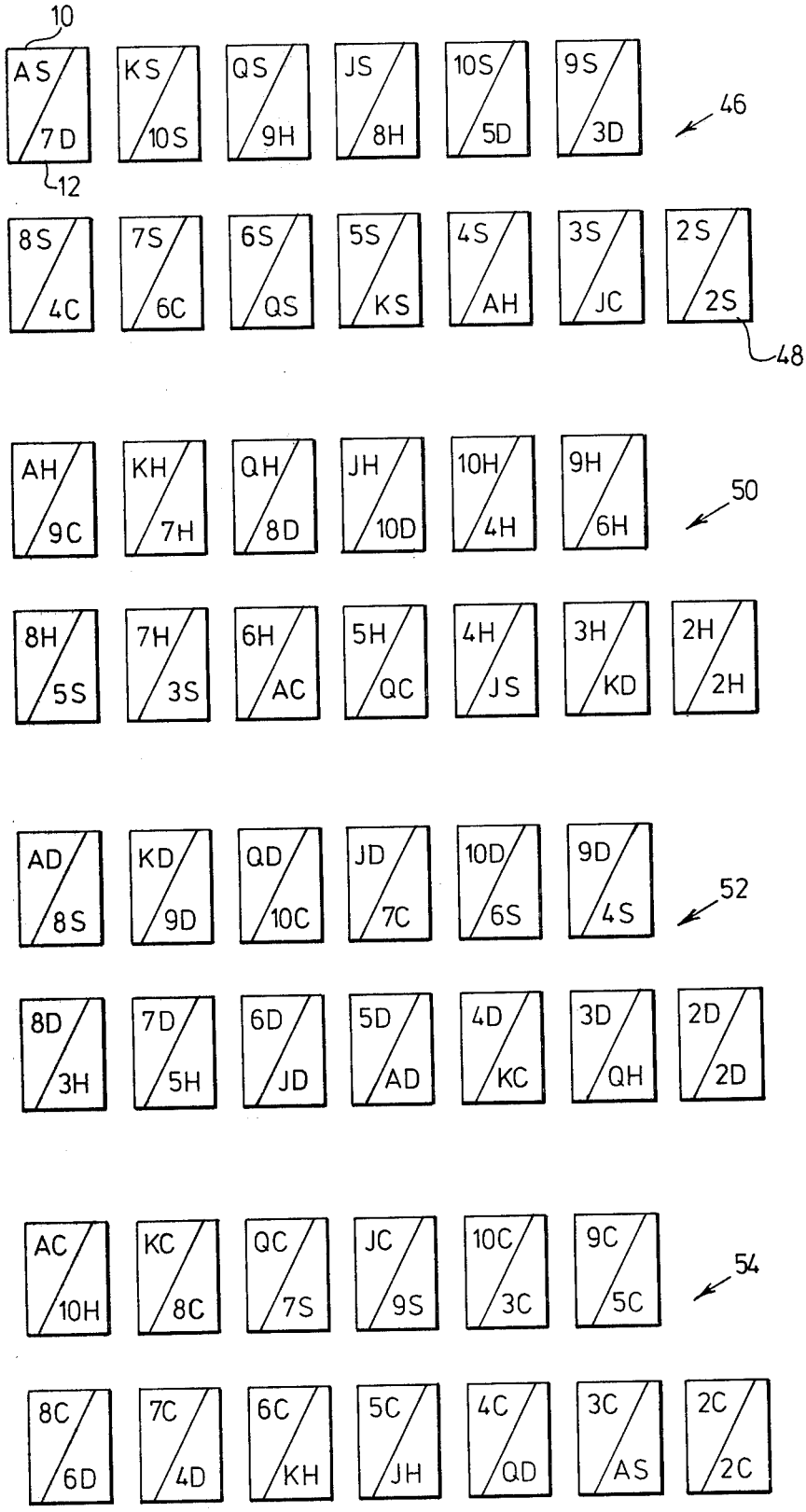
FIG. 8 shows diagrammatically the front faces of the pack, illustrating the specific major/minor deck couplings of the pack.

FIG. 8 shows diagrammatically a full pack of 52 cards according to the invention, indicating the combination of card-suit values which can appear on each of the 48 split cards. It is to be emphasized that the precise couplings shown on FIG. 8 are exemplary only, and not limiting. Other card combinations are possible, within the framework of the preferred embodiment of the invention. In the drawing of FIG. 8, the initials S, H, D & C have been used to indicate the respective suits spade, heart, diamond and club. In the drawing of FIG. 8, all of the major zones 10 are shown to the upper left of the cards, and all of the minor zones 12 are shown to the lower right of the card.

In FIG. 8, the first group of cards generally designated 46 comprises the 13 cards representing the major spade suit. Thus, each card has a different spade value in its first zone 10, at its upper left portion. The two of spades card 48, whilst having the general appearance of the split card on its front face, represents the two of spades in both the major and minor decks. An inspection of the arrangement of values for the minor zones 12 of the major spade cards 46 will reveal that there are three minor diamonds, three minor spades, three minor hearts and three minor clubs. Also, the honor cards are coupled with non-honor cards in the minor zones.

Similarly, group 50 is the 13 cards of the pack having the thirteen different heart values as the major deck component, in first zone 10. Again it will be observed that the two of hearts is split into two equal values, and that, of the remaining major heart cards, three are coupled with minor club values, three with minor heart values, three with minor diamond values and three with minor spade values. The same general arrangement will be observed with the third group of cards 52 in which the major zones 10 represent diamond values, and the fourth group of cards 54 in which the major zones represent club values.

A further inspection of all the card representations on FIG. 8, which shows a complete pack according to the invention, will show that there is no coupling of honor cards together on the same card. It will also be noted that, of all the eight ace cards in the pack, i.e. those which represent one of the major deck aces and one of the minor deck aces, the respective major or minor complement is a different non-honor card. The same is true of all the eight king cards, all the eight queen cards and all the eight jack cards. A combination such as ace—seven, shown as the first group 46, is not duplicated throughout the pack, none of the other ace cards being coupled with a seven. The same general arrangement is true of all of the other honor cards through the pack.

It will in addition be observed that the eight split cards bearing a given card value, e.g. the eight ace cards, are coupled with two cards of each of the four suits clubs, diamonds, hearts and spades. This again makes for major decks and minor decks within the same pack of 52 cards, which are as different from each other as possible, so as to provide for the necessary balance between the two decks, for playing the standard card games.

Effectively, the pack of cards according to the invention comprises four decks of cards in one, since there are four different combinations of the cards which can be played with the pack. One can play major deck only, minor deck only, mixed deck, or major and minor decks, at the choice and option of the players or any individual player, according to the rules of the game.

A general indication of the manner in which various well known card games are played with a pack of cards according to the invention, e.g. the pack of cards as illustrated in FIG. 8, will now be given so that the versatility and increased game possibilities with a pack of cards according to the invention will be apparent to card players.

BRIDGE

In playing bridge, and most of the other games where it is required, the major deck is of higher value than the minor deck. For the game of bridge, bidding proceeds normally, except that a player may bid "one club minor" as the lowest opening bid, which bid can be superceded by a bid of "one club major". Thus, partners in a bridge game by means of their bidding decide whether to play a hand in the major deck or the minor deck, with trumps accordingly. In the pack of cards according to the invention, therefore, there are ten bids (without double or redouble) before one proceeds to the two level. Once it has been decided that the contract is to be played in, for example, the minor deck with a given suit as trump, the major deck is ignored in playing for the tricks.

KNOCK-RUMMY

In rummy games with the pack according to the invention, the palyers can be playing or collecting either major or minor cards, and all players do not have to be using the same deck in their collecting. A great degree of skill is required to follow the cards being picked up by a player's opponent.

CRIBBAGE

The pack of cards according to the invention allows two card cribbage, because of the split cards. The regular game of cribbage can be played with the major deck only, the minor deck only, both decks, or a mixed deck. In major deck play, a player is only allowed to tally his score using major deck values in his hand. In minor deck play, similarly only minor deck values are used. In play with both major and minor decks, a player may tally the total score of using the major deck separately and the minor deck separately. In mixed play, the player may use the value from each card which is to his best advantage, and combine a major deck value from one card with a minor deck value of another. For example, in the hand shown in FIGS. 3, 4 and 5, the major deck cribbage score is 15–2 (ace plus ace plus seven plus six) and two for the pair of aces, obtained from the major values shown in FIG. 3. The minor deck cribbage score is only two for the pair of fours (FIG. 4). The major and minor score is the sum of these two values, namely six. If mixed major and minor deck play is allowed, the player can score 15–2 (nine of clubs minor plus six of hearts major), 15–4 (ace of hearts major plus six of hearts major plus eight of spades minor), 15–6 (ace of hearts major plus ten of hearts major plus four of diamonds minor), 15–8 (ace of clubs minor plus ten of hearts major plus four of diamonds minor), 15–10 (ten of hearts major plus ace of diamonds major plus four of diamonds minor), 15–12 (eight of spades minor plus seven of clubs major) and so on. In a further alternative, a rule may be declared in which each card of a hand may be used for one of is values only, regardless of major or minor, so that a player must arrange his cards upright to his best advantage, for each hand. In one method of playing, the major deck values only are used for a given portion of the cribbage noard, then both decks are used, combined to give large scores, whilst proceeding along a second portion of the cribbage board, and finally, to terminate the game, play reverts to one deck only.

EUCHRE

In the game of euchre, 32 cards from the pack according to the invention are used, comprising the eight ace cards, the eight king cards, the eight queen cards and the eight jack cards. In all cases, the major suit of the same card is higher in value than the minor suit. The game may be played with five card hands or seven card hands, so that it can be won with three or four tricks respectively.

POKER

This game offers almost unlimited scope with the pack of cards according to the present invention. Normally, the dealer is given the choice at the start of a hand, whether the major deck, the minor deck, both decks or a mixed deck shall be played. With the example shown in FIGS. 3–5, if the dealer declares major deck play, the holder of the hand has a pair of aces, according to FIG. 3. If the dealer declares minor deck play, the hand is merely ace high, according to FIG. 4. If however the dealer declares mixed deck play, the player arranges his hand to his best advantage using major and minor values, and would likely select the mode shown in FIG. 5, which is a "full house".

HEARTS

This game, in which players attempt to avoid winning tricks containing the queen of spades or any card of the heart suit, the hand is declared to be played in either the major deck or the minor deck, but heart values from both major and minor decks are counted in tallying the score at the end of a hand. In this manner, exercise of a great deal more skill is required, to avoid picking up excess heart value cards, since great attention must be paid to the deck not in play, as well as to the selected deck being played. In the alternative, the leader may declare upon leading a card whether it is to be considered a lead in its major suit or its minor suit, and then all subsequent players must follow suit, with a card of appropriate suit in either its major or minor deck. Thus, if the dealer declares the lead to be a spade, all players must follow with a spade if they have one in their hand, whether that spade appear in a minor deck or a major deck. With the pack according to the invention, in which the major/minor combinations are arranged to be as different from each other as reasonably possible throughout the pack, the possibility that a player can void one suit in his hand for a game of hearts is virtually eliminated.

DOMINOES

A new version of the famous dominoes game can be played with a deck of cards according to the invention, in which each player follows the value of a card at the end of the line deposited on the table. In the game the deuce is used as a wild card and can be named to any single value at the election of the player who plays the deuce. The game terminates when on player has played all his cards.

The pack of cards according to the invention thus provides increased possibilities for the playing of a variety of standard card games, increases the skill content required, and enlarges the scope of the games to be played. At the same time, the pack of cards according to the invention is kept closely similar to standard playing cards, so that a players basic familiarity with playing cards and card games is unaffected, and his previously acquired card playing skill is put to use and enlarged.

What I claim:

1. A pack of playing cards comprising 52 cards, each of said cards being of generally the same rectangular configuration and standard size, and having visually similar rear faces;

each of said cards being split to prove a front face divided into first and second visually distinctive zones, each of said first and second zones bearing readily recognizable indicia representative of a standard playing card value selected from deuce through ace of a standard playing card suit selected from club, diamond, heart and spade, each of the first zones of the 52 cards representing a different value-suit combination, and each of the second zones representing a different value-suit combination;

four out of said 52 cards having respective first and second zones bearing indicia representative of the same suit-value combination and selected from deuce of clubs, deuce of diamonds, deuce of hearts and deuce of spades;

the remaining 48 of said cards each having a first zone representing a different value-suit combination from the value-suit combination represented by the second zone of the same split card, the coupling of suit values on the split-value cards being chosen and arranged to provide, among the 12 cards in which the first zone represents the values three through ace of a given suit selected from clubs, diamonds, hearts and spades, that there are 3 cards of which the second zone represents a club value, 3 cards of which the second zone represents a diamond value, 3 cards of which the second zone represents a heart value and 3 cards of which the second zone represents a spade value;

each card in which the first visually distinctive zone represents an honor card value (namely ace, king, queen or jack) having its second visually distinctive zone representing a non-honor card value (namely three, four, five, six, seven, eight, nine or ten);

the division between the first zone and the second zone of the front face of each of said 48 split value cards being along a diagonal line passing through the approximate diagonal center of the respective split-value card and extending diagonally from the approximate diagonal center towards opposed points on the shorter side of the card located from ½ cm to 2 cm from the top right and bottom left corners of the front face of the card, as the card is held upright and viewed toward the front face, the division line at a point ½-1 ½ cm from the respective shorter sides making obtuse angled turns and proceeding parallel with said shorter sides to intersect the respective longer sides a distance of about ½-1 ½cm from the respective top right and bottom left corners.

2. The pack of playing cards according to claim 1, wherein all of the eight split cards which have one of their respective first and second zones representing a given honor card value have their respective complementary second or first zones representing a card value different from that of the other seven of said eight honor value-representing split cards.

3. The pack of playing cards according to claim 2, wherein, among the eight split cards having one of said first and second zones representing a given value three through ace, there are two cards having complementary second or first said zones representing club values, two cards having complementary second or first zones representing diamond values, two cards having complementary second or first zones representing heart values, and two cards having complementary second or first zones representing spade values.

4. The pack of playing cards according to claim 3 including at least 2 jokers.

5. The pack of playing cards according to claim 3 including indicator cards bearing on one face indicia denoting modes of play.

6. The pack of playing cards according to claim 3 wherein each of the 48 cards has, in its first zone, indicia denoting the suit and value represented by its second zone, and correspondingly has, in its second zone, indicia denoting the suit and value represented by its first zone.

* * * * *